United States Patent [19]

Cahill

[11] 4,418,628

[45] Dec. 6, 1983

[54] SECURITY TRANSFER ARRANGEMENTS

[75] Inventor: Dermot J. Cahill, Bedford, England

[73] Assignee: Chubb Security Installations Limited, London, England

[21] Appl. No.: 298,543

[22] Filed: Sep. 1, 1981

[30] Foreign Application Priority Data

Sep. 10, 1980 [GB] United Kingdom ..... 8029302

[51] Int. Cl.[3] ..... E05G 7/00

[52] U.S. Cl. ..... 109/19; 109/55

[58] Field of Search ..... 109/10, 11, 12, 13, 109/14, 15, 16, 17, 18, 19, 55, 64, 66, 73; 160/113, 114, 201

[56] References Cited

U.S. PATENT DOCUMENTS

| | | | |
|---|---|---|---|
| 270,895 | 1/1883 | Guest | 109/19 |
| 983,663 | 2/1911 | White | 109/17 |
| 1,611,013 | 12/1926 | Francke | 160/114 |
| 1,958,321 | 5/1934 | Stadtler | 109/19 |
| 2,078,665 | 4/1937 | Horsley | 160/201 |
| 3,129,040 | 4/1964 | DeRose | 160/201 |
| 3,682,113 | 8/1972 | McClellan | 109/19 |
| 4,299,175 | 11/1981 | Bourlier et al. | 109/19 |

FOREIGN PATENT DOCUMENTS

| | | | |
|---|---|---|---|
| 7401615 | of 1974 | Netherlands | 109/19 |
| 388886 | of 1933 | United Kingdom | 109/73 |

*Primary Examiner*—Robert P. Swiatek
*Assistant Examiner*—David I. Tarnoff
*Attorney, Agent, or Firm*—Pollock, Vande Sande & Priddy

[57] ABSTRACT

A security transfer unit includes a hollow box-structure that has open ends on opposite sides of a security barrier and is supported from side-frames with a clearance underneath. A rolling shutter encircles the box-structure to block access to either end to the chamber through openings in the unit casing. The shutter is driven to bring an aperture therein into register with the openings in turn so that access to the chamber can be gained through only one of them at a time. Drive is in one direction only and is interrupted with the shutter blocking both openings when the aperture is located in register with an aperture in the box-structure, so as to enable viewing of the contents of the transfer chamber through a window above.

10 Claims, 4 Drawing Figures

SECURITY TRANSFER ARRANGEMENTS

This invention relates to security transfer arrangements of the kind in which access to a chamber to entering items into, and removing them from, the chamber, is gained via two mutually-spaced openings only one of which is unblocked to give access to the chamber, at a time.

Security transfer arrangements of this above-specified kind are described in U.K. patent specification Nos. 532,536 and 1,419,382 and find application in particular, though not exclusively, in banks and other institutions where cash and other valuables are to be transferred through a security barrier between regions of open and restricted access. These earlier security transfer arrangements involve hinged-doors for blocking individually the openings to the chamber on either side of the security barrier. Interlocking between the two doors is provided to enable only one of the doors to be opened to give access to the chamber, at a time. Cash or other items can be transferred through the barrier from either side, simply by entering them into the chamber through the door on that side, and then closing this door so as to enable the deposited items to be removed from the chamber through the other door on the opposite side of the barrier.

Although the use of hinged doors is generally satisfactory where the size of the compartment is appropriate to small quantities of cash or other items of moderate bulk, such is not the case where a compartment of larger size is required for the transfer, for example, of substantial quantities of cash or bullion. It has been the practice in the latter circumstances to provide laterally-sliding doors, but these necessitate the utilization of considerable space and involve complicated mechanisms for achieving the interlocking of the doors required to preserve security. It is one of the objects of the present invention to provide a security transfer arrangement of the above-specified kind that may be utilized to avoid these disadvantages.

According to the present invention there is provided a security transfer arrangement of the above-specified kind wherein flexible shutter means for blocking access to the chamber through both openings is displaceable relative to the chamber for selectively bringing an aperture of the shutter means into alignment with either one of the openings, so as thereby to enable access to the chamber through this opening, while access through the other opening remains blocked by the shutter means.

The use of shutter means in accordance with the present invention is particularly advantageous in that it avoids the necessity for any interlocking mechanism such as required where separate doors are used for blocking the openings to the chamber. Moreover the use of the shutter means enables a compact construction of security transfer arrangement to be achieved that is readily adaptable to meeting requirements for varying sizes of transfer chamber.

The shutter means may be a rolling shutter and in particular may be of a closely slatted construction to provide flexibility together with security from penetration. Such a shutter may encircle the chamber to be displaceable round it for selectively unblocking the openings into the chamber one at a time. Just one aperture may be provided through the shutter for alignment with the openings in providing access to the chamber.

In this respect the shutter may be displaceable between a first position in which the aperture is in register with a first of the openings to enable access therethrough to the chamber while the shutter blocks the second opening, and a second position in which the aperture is in register with the said second opening to enable access to the chamber through the second opening while the first opening is blocked. There may be a third position of the shutter means in which both openings are blocked by it and the aperture is in register with a window through which the contents of the chamber can be inspected.

A security transfer arrangement in accordance with the present invention, and provided as a discrete unit mounted in a security barrier of a bank, will now be described, by way of example, with reference to the accompanying drawings, in which.

Figure 1:
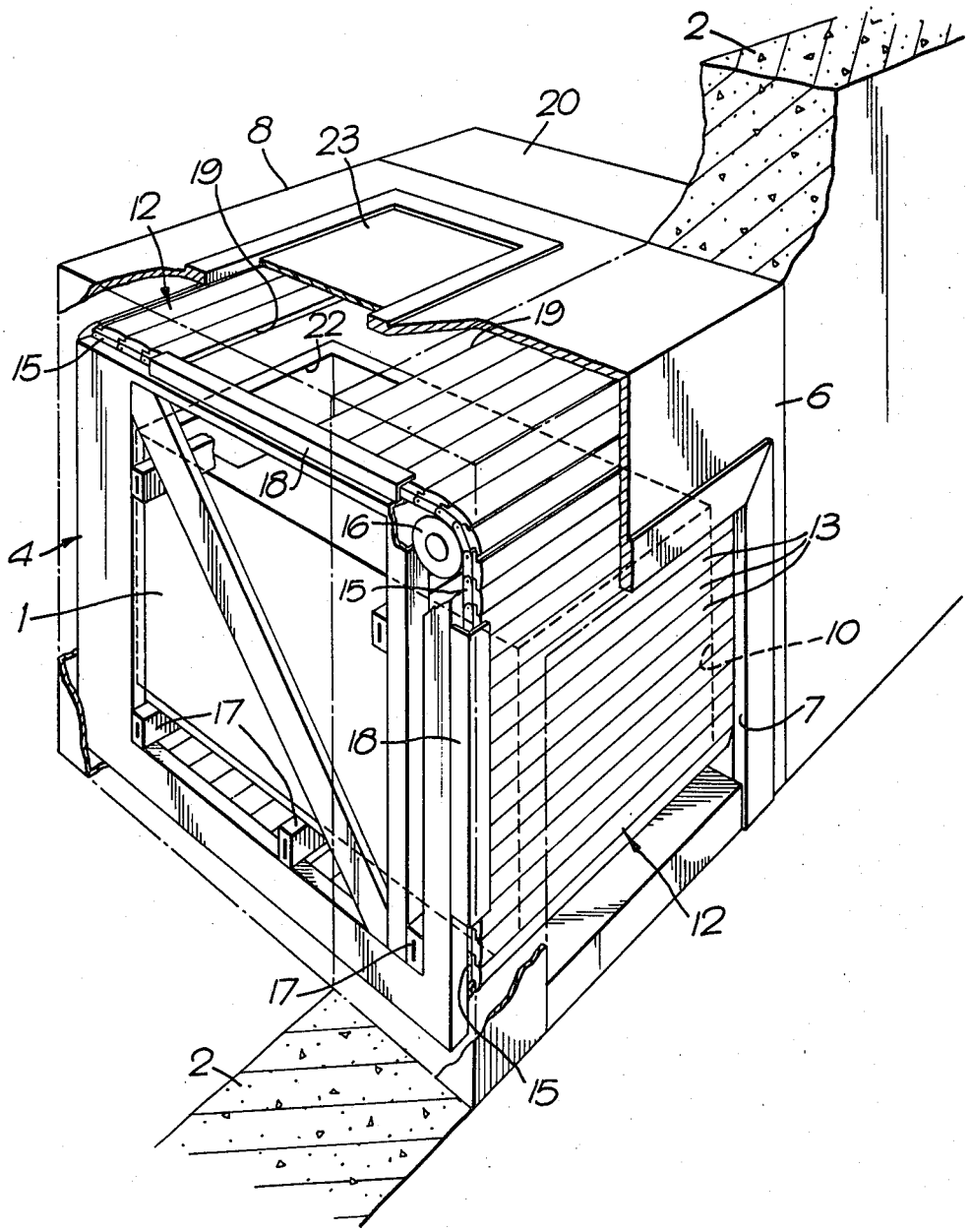
FIG. 1 is a sectional perspective view of the installation.
Figure 2:
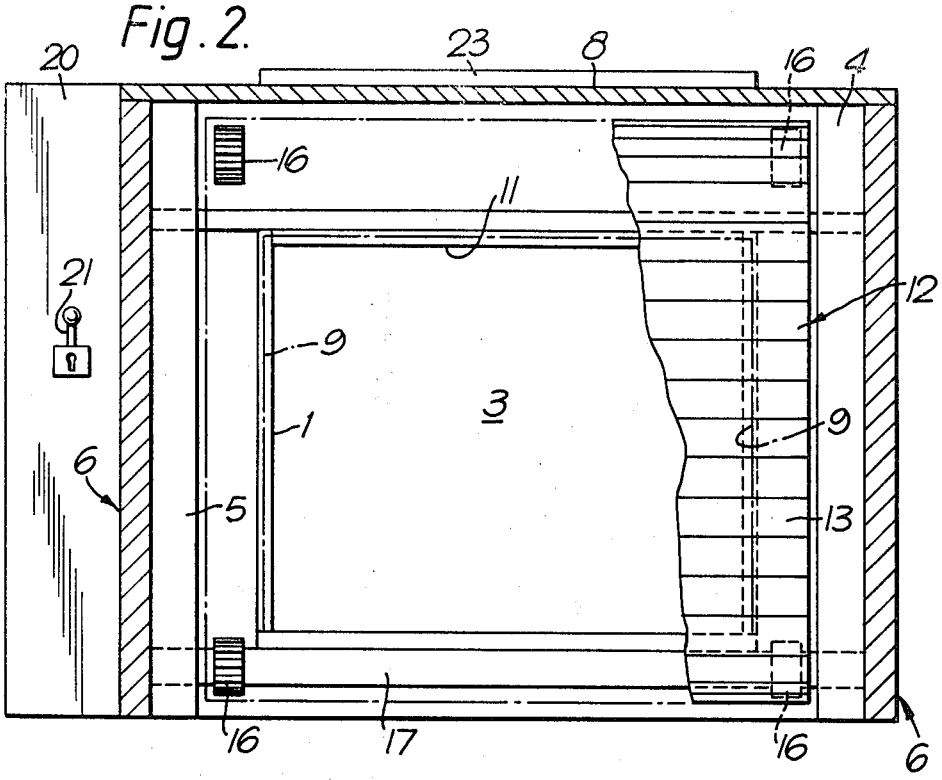
FIG. 2 is a sectional end-elevation of the security transfer unit from inside the security barrier of the bank.

Referring to FIGS. 1 and 2, a hollow, open-ended, rectangular box structure 1 of the security transfer unit extends through the wall 2 of the security barrier to provide a rectangular chamber 3 (having, for example, a height of some 60 cm, a width of some 92 cm and a depth of some 97 cm) through which items can be transferred from one side to the other of the barrier. The structure 1 is mounted on two rectangular side-frames 4 and 5 within a casing 6 that has an opening 7 on the outside of the security barrier. A rear portion 8 of the casing 6 projects from the wall 2 inside the barrier and has an opening 9 corresponding to the opening 7. It is by means of these front and rear openings 7 and 9, which are aligned with the open front and rear ends 10 and 11 respectively of the structure 1, that access to the chamber 3 is gained. Both ends 10 and 11 are normally (as illustrated) covered by a slatted shutter 12 to block access to the chamber 3 through each opening 7 and 9.

Figure 3:
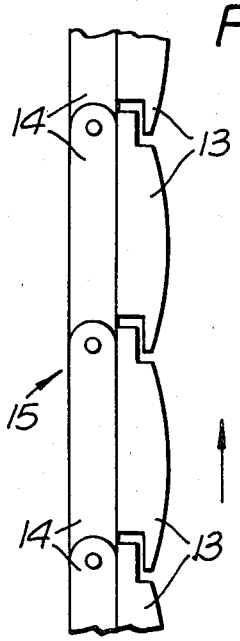
FIG. 3 illustrates details of a slatted rolling-shutter of the security transfer unit.

The shutter 12 consists of a multiplicity of horizontal steel slats 13 that extend closely side-by-side between the frames 4 and 5 within the casing 6. Each slat 13, as illustrated in FIG. 3, overlaps the next slat 13 slightly so as to ensure that there is no gap between them, and is attached at its ends to individual links 14 of two endless-loop conveyor chains 15 that are engaged with toothed wheels 16 on the two side-frames 4 and 5 respectively. Each frame 4 and 5 has a wheel 16 adjacent to each of its four corners such that, with the chains 15 trained round the two sets of four wheels 16, the shutter 12 encircles the structure 1 between the frames 4 and 5. More particularly, from the top of the unit the shutter 12 extends on the chains 15 down across the open end 11 of the structure 1, forwardly underneath the structure 1 and then up across its open end 10 to return to the top. The structure 1 is supported from the side-frames 4 and 5 on cross-beams 17 to provide the clearance required underneath, and all legs of the path around the structure 1 are provided with guides 18 for restraining the chains 15 and the attached slats 13 from bellying. Slats 13 are provided around the complete loop except throughout a single length almost equal to the height of each opening 7 and 9; in this way the shutter 12 has an aperture 19 therein which when aligned with either opening 7 or 9 will allow full access to be gained to the chamber 3 through that opening.

The flexible shutter 12 may be rolled round to bring the aperture 19 into register with either opening 7 or 9 by driving the chains 15 appropriately via the wheels 16. In this respect the four wheels 16 in the rear portion 8 of the unit are driven from an electrically-powered drive-unit 20 in accordance with the setting of a key-released control 21. In a first operational setting of the control 21, the shutter 12 is driven from the unit 20 to align the aperture 19 with the rear opening 9 so as to enable access to the chamber 3 from within the security barrier; the front opening 7 outside the security barrier remains blocked by the shutter 12 at this time. If the control 21 is now moved on to a second operational setting, the unit 20 drives the shutter 12 to locate the aperture 19 in alignment with the front opening 7 so as to allow access to be gained to the chamber 3 from outside the barrier; the rear opening 9 is at this time blocked by the shutter 12 to preserve the barrier security.

Return of the control 21 to its neutral setting (this being the setting adopted when the control 21 is locked and in which it remains until unlocked by its key) causes the unit 20 to drive the shutter 12 to block both openings 7 and 9 and locate the aperture 19 within the rear portion 8 of the casing 6 behind the wall 2. More particularly, and as illustrated in FIG. 1, the aperture 19 is then located above and in register with an aperture 22 in the top of the structure 1. A window 23 in the casing 6 is aligned with the aperture 22 so that when the shutter 12 is in this position, the staff inside the security barrier can accordingly readily inspect the contents of the chamber 3 through the window 23 before the control 21 is operated again to align the aperture 19 with the rear opening 9 and enable such contents admission to the restricted area behind the wall 2.

The unit 20 drives the shutter 12 in the one direction only, that is to say such that the aperture 19 always passes in the direction from the opening 7 to the opening 9 beneath the chamber 3 and from the opening 9 to the opening 7 above it. Although this is not essential it has particular advantage from the aspect of security. Furthermore, drive to the shutter 12 is always interrupted when in passage of the aperture 19 from the opening 9, it reaches the position beneath the window 23 so as to enable inspection to take place.

Figure 4:
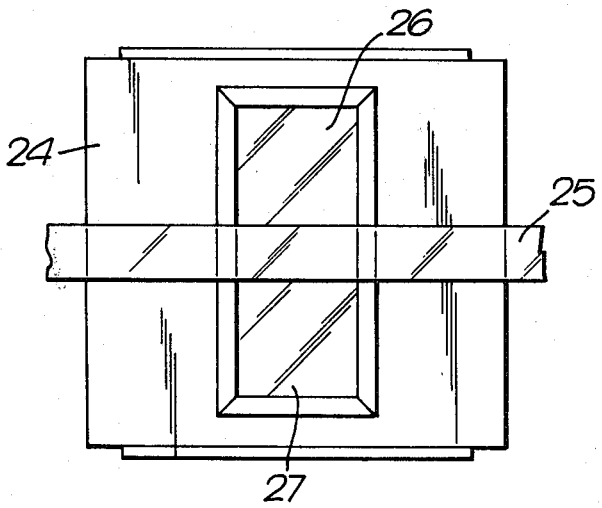
FIG. 4 illustrates in plan a modification of the security transfer unit and its installation.

Provision may be made for extending the inspection window forwardly to enable a person outside the security barrier to view the contents of the chamber 3 also. A modification of the unit to this end is illustrated in FIG. 4, in which the casing 24 of the modified unit projects either side of a security-glass wall 25. The inspection window in this case has two parts, one part 26 extending behind the wall 25 and the other part 27 in front. Although it would be possible in this case for the shutter to be driven to align its aperture with the two parts 26 and 27 of the window in turn, it would more generally be driven to locate the aperture beneath them both at the same time.

With the security transfer arrangement described, items can be transferred through the chamber 3 without the danger that the security of wall 2 will be compromised, and the construction of the security transfer unit used to achieve this avoids the need for hinged or sliding doors and the complication of a mechanism for interlocking or otherwise controlling them. The use of the apertured shutter 12 is particularly convenient and enables a compact structure to be provided for the size of chamber 3 required, and more particularly enables very simple control of access to be achieved. The contruction of unit is moreover readily adaptable to meet a wide range of size requirements from small (for use for example in transferring small quantities of cash) to very large (for use for example in transferring large quantities of bullion).

Although with the shutter of the arrangement described above there is just one aperture, as preferred, it would be possible to utilize more than one, such apertures being spaced apart round the shutter 12 to be brought in turn into alignment with the openings 7 and 9 as the shutter 12 is displaced. Each aperture could be used for alignment with either opening 7 and 9 or for alignment with a respective one of the openings 7 and 9 only; nonetheless it would be desirable for security in both cases to ensure that the spacing of the apertures from one another round the shutter 12 is such that they cannot possibly be brought into alignment with the two openings 7 and 9 together.

I claim:

1. A security transfer unit comprising means defining a chamber for receiving items to be transferred, casing means to enclose said chamber, said casing means having two manually-spaced openings therein to enable access to be gained for entering items into, and removing them from, said chamber, a flexible shutter encircling said chamber within said casing means for at times blocking access to said chamber through both openings, said shutter having at least one aperture therein, means mounting said shutter for displacement round said chamber within said casing means between a first position in which a said aperture in the shutter is located in register with a first of said openings while the second opening is blocked by the shutter, and a second position in which a said aperture in the shutter is located in register with the second opening while the first opening is blocked by the shutter, and means selectively operable externally of said casing means for displacing said shutter from one to the other of its first and second positions.

2. A security transfer unit according to claim 1 wherein said shutter is a horizontally-slatted rolling shutter.

3. In a security transfer arrangement in which access to a chamber for entering items into, and removing them from, the chamber, is gained via two mutually-spaced openings only one of which is unblocked to give access to the chamber, at a time, the improvement wherein a unitary flexible shutter encircles the chamber for blocking access to the chamber through both openings, said shutter is a horizontally-slatted shutter having a single aperture therein, and said shutter is mounted for rolling displacement as a whole round an endless-loop path that encircles said chamber in a vertical plane, said shutter being displaceable round said path selectively between a first position in which said single aperture is in register with a first of the openings to enable access therethrough to the chamber while the shutter blocks the second opening, and a second position in which said single aperture is in register with the said second opening to enable access to the chamber through the second opening while the first opening is blocked by the shutter.

4. A security transfer arrangement according to claim 3 including drive means operable to drive the shutter between its said first and second positions.

5. A security transfer arrangement according to claim 4 wherein said drive means is operable to drive the shutter in one direction only round the said chamber.

6. A security transfer arrangement according to claim 3 including an inspection window fixed with respect to, and spaced from, said openings, said shutter having a third position in which both of said openings are blocked by the shutter and said aperture is in register with the window to enable the contents of the chamber to be inspected through the aligned window and aperture.

7. A security transfer arrangement according to claim 6 including drive means operable selectively to drive the shutter from one to the other of said first, second and third positions in turn.

8. In a security transfer arrangement in which access to a chamber for entering items into, and removing them from, the chamber, is gained via two mutually-spaced openings only one of which is unblocked to give access to the chamber, at a time, the improvement wherein a box structure defines said chamber, said openings comprising mutually-spaced openings in said box structure, and wherein flexible shutter means blocks access to the chamber through both openings, and said shutter means comprises endless-loop conveyor means encircling the box structure and mounted for selective displacement round the box structure, and slats carried with said conveyor means to define a displaceable shutter barrier encircling the box structure, said slats being mounted on said endless-loop conveyor means to extend closely side by side round the complete loop thereof except for at least one portion of that loop so as to define an aperture in the shutter barrier, and said shutter barrier being displaceable with said conveyor means round said box structure for bringing said aperture into register with selectively either one of the openings, so as thereby to enable access to the chamber through this opening, while access through the other opening remains blocked by said shutter barrier.

9. A security transfer arrangement according to claim 8 wherein successive slats overlap one another slightly.

10. In a security transfer arrangement in which access to a chamber for entering items into, and removing them from, the chamber, is gained via two mutually-spaced openings only one of which is unblocked to give access to the chamber, at a time, the improvement wherein flexible shutter means blocks access to the chamber through both openings, and said shutter means comprises endless-loop conveyor means encircling the chamber and mounted for selective displacement round the chamber, and slats carried with said conveyor means to define a displaceable shutter barrier encircling the chamber, said slats being mounted on said endless-loop conveyor means to extend closely side by side round the complete loop thereof except for at least one portion of that loop so as to define an aperture in the shutter barrier, and said shutter barrier being displaceable with said conveyor means for bringing said aperture into register with selectively either one of the openings, so as thereby to enable access to the chamber through this opening, while access through the other opening remains blocked by said shutter barrier, said arrangement including an open-ended box structure defining said chamber, and means to support said structure from both sides, said shutter means encircling said structure to pass underneath it and across both of its open ends.

* * * * *